US010606196B2

(12) United States Patent
Cao et al.

(10) Patent No.: US 10,606,196 B2
(45) Date of Patent: Mar. 31, 2020

(54) FUSER TEMPERATURE CONTROL IN AN IMAGING DEVICE

(71) Applicant: LEXMARK INTERNATIONAL, INC., Lexington, KY (US)

(72) Inventors: Jichang Cao, Lexington, KY (US); Douglas Campbell Hamilton, Lexington, KY (US); Benjamin Karnik Johnson, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/381,130

(22) Filed: Apr. 11, 2019

(65) Prior Publication Data

US 2019/0235421 A1 Aug. 1, 2019

Related U.S. Application Data

(63) Continuation of application No. 15/797,376, filed on Oct. 30, 2017, now abandoned.

(51) Int. Cl.
*G03G 15/20* (2006.01)

(52) U.S. Cl.
CPC ..... *G03G 15/205* (2013.01); *G03G 15/2028* (2013.01); *G03G 2215/2045* (2013.01)

(58) Field of Classification Search
None
See application file for complete search history.

(56) References Cited

U.S. PATENT DOCUMENTS

2014/0147150 A1* 5/2014 Sato ..... G03G 15/2039 399/69
2015/0220028 A1* 8/2015 Samei ..... G03G 15/2039 399/69
2016/0018769 A1* 1/2016 Wagatsuma ..... G03G 15/2032 399/69

FOREIGN PATENT DOCUMENTS

JP 2004326098 A * 11/2004 ..... G03G 15/2046
JP 2016136225 A * 7/2016

* cited by examiner

*Primary Examiner* — Victor Verbitsky

(57) ABSTRACT

A fuser assembly includes a heated member and a backup member defining a fusing nip. Toner fuses to media in the nip at a fusing temperature and process speed during an imaging operation. Upon receipt of a command to commence imaging, a controller operates a heater to heat the fuser assembly to a first temperature less than the fusing temperature and operates a motor to rotate the fuser assembly at a speed lower than the process speed to prevent overheating the heated and backup members. Before a first media reaches the fusing nip, a speed of the motor is increased to the process speed to properly advance the media through the nip at the process speed. Upon the first media arriving at the fusing nip, the controller increases the temperature of the heater to a second temperature greater than the first temperature to prevent cold offset.

15 Claims, 3 Drawing Sheets

FUSER TEMPERATURE CONTROL IN AN IMAGING DEVICE

This application claims priority as a continuation of U.S. application Ser. No. 15/797,376, filed Oct. 30, 2017, having the same title.

FIELD OF THE INVENTION

The present disclosure relates to a fuser assembly in an electrophotographic imaging device. It relates further to thermally controlling the fuser assembly.

BACKGROUND

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface and applying toner. The toner is transferred to media where it becomes fixed by application of heat and pressure in a fuser assembly.

Fuser assemblies take many forms. They include hot rolls or belts and either presses against a backup roll to form a fusing nip. The assemblies operate at various temperatures and process speeds during imaging operations. Designers match materials of the rolls and belts to the thermal constraints of the system. Designs with high thermal conductivity and low thermal mass, for example, cause temperatures too high for fusing when media is not present at the fusing nip, as occurs before media arrives at the fusing nip and between adjacent sheets. Designs with high thermal conductivity, low density and low specific heat may also exhibit 'hot offset' upon imaging a leading portion of a first sheet of media at the fusing nip and 'cold offset' at the trailing portion during imaging the first sheet. 'Hot offset' is a condition whereby the toner sticks to the belts or rolls because the temperature of the fusing nip is overly hot. 'Cold offset' is a condition whereby the fusing temperature is relatively low and the toner does not fully melt and can easily rub or flake off the media. These conditions can also compound problems for imaging subsequent sheets of media in a same imaging operation. The inventors recognize the need for overcoming these problems, including a control algorithm to manage thermal phenomena before, during and after imaging the first sheet while minimizing poor fusing grade.

SUMMARY

A fuser assembly includes a heated member and a backup member defining a fusing nip. A heater heats the heated member. Toner fuses to media in the nip at a fusing temperature and process speed during an imaging operation. A motor connects to either or both the heated and backup members to cause rotation. A controller connects to both the heater and the motor. Upon receipt of a command to commence imaging, the controller operates the heater to heat the fuser assembly to a first temperature less than the fusing temperature and operates the motor to rotate at a speed lower than the process speed to prevent overheating of the heated and backup members. Before a first media reaches the fusing nip, a speed of the motor is increased to the process speed to properly advance the media through the nip at the process speed. Upon the first media arriving at the fusing nip, the controller increases the temperature of the heater to a second temperature, fusing temperature, greater than the first temperature, warm up temperature, to prevent cold offset. A memory accessible by the controller stores the necessary temperature values of the heater. The temperature values are correlated to the temperature of the backup member, process speed and type of the media. An inter-page gap between adjacent sheets of media is measured to determine reapplication or not of the control algorithm. Measurement includes time, distance or both. Still other embodiments are noted.

DETAILED DESCRIPTION OF THE ILLUSTRATED EMBODIMENTS

Figure 1:
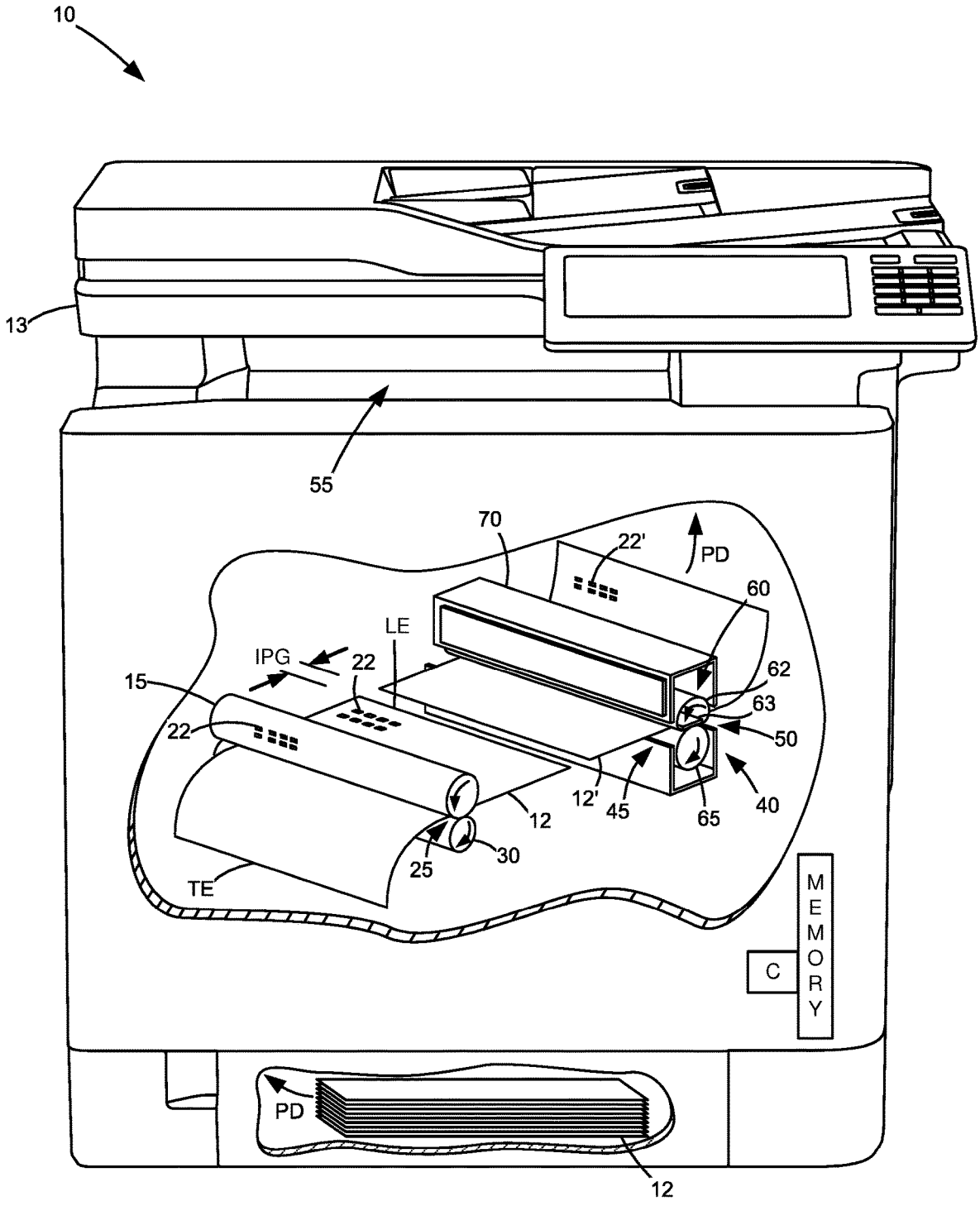
FIG. 1 is a diagrammatic view of an imaging device, including cutaway with an exaggerated view of a fuser assembly.

With reference to FIG. 1, an electrophotographic imaging device 10 prints images on media 12. Image data is supplied to the imaging device 10 from a scanner 13, computer, laptop, mobile device, or like computing device. The sources communicate directly or indirectly with the imaging device 10 via a wired and/or wireless connection. A controller (C), such as an ASIC(s), circuit(s), microprocessor(s), etc., receives the image data and controls hardware of the imaging device 10 to convert the image data to printed data on the sheets of media 12. The controller has access to a local or remote memory that stores parameters useful to conducting imaging operations.

During use, the controller (C) activates one or more laser or light sources (not shown) to selectively discharge areas of a photoconductive (PC) drum 15 to create a latent image of the image data thereon. Toner particles are applied to the latent image to create a toned image 22 on the PC drum 15. At a transfer nip 25 formed between the PC drum 15 and a transfer roll 30, for example, the toned image 22 is electrostatically transferred from the PC drum 15 to a media sheet 12 travelling in a process direction PD. The media sheet 12' with toned image 22 enters a fuser assembly 40 through its entrance 45 for application of heat and pressure to fix the toned image 22 to the media sheet 12'. Media sheet 12' with fused toner image 22' exits the fuser assembly 40 through its exit 50 and is either deposited into an output media area 55 for collection by a user or enters a duplex media path for transport back to the PC drum 15 for imaging on the reverse side of the media sheet. The fuser assembly is disposed within a housing 70 for configuration as a customer replaceable unit for ease of maintenance. The housing includes a heated member 60 and backup member 65.

Figure 2:
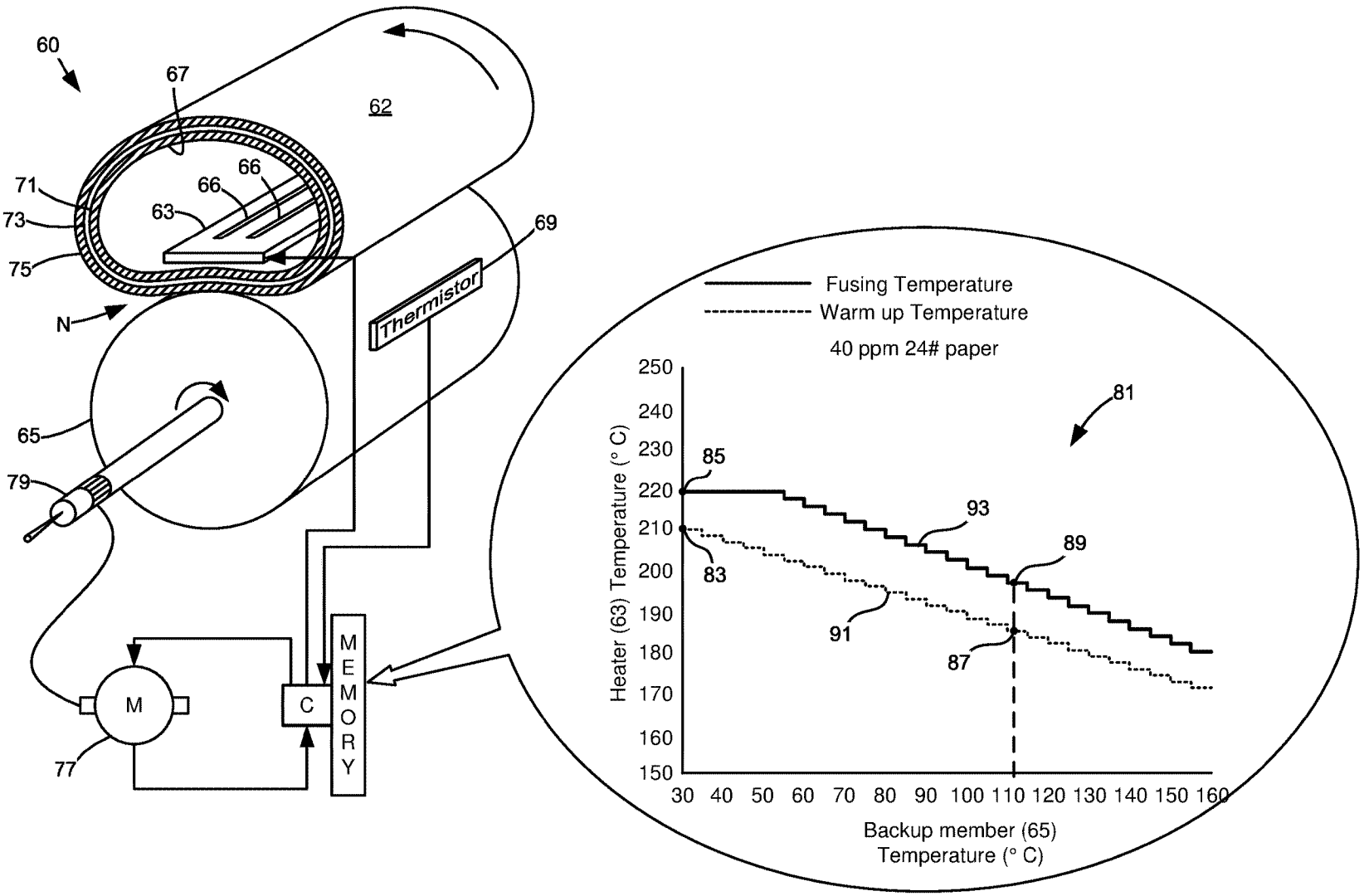
FIG. 2 is a diagrammatic view of a representative fuser assembly with fusing nip and control therefor.

As seen in FIG. 2, the heated member 60 and the backup member 65 form a fusing nip (N). The nip provides pressure and heat to fix the toner to the media. The heat is generated by a heater 63. The heater contacts an inner surface 67 of an endless belt 62 and transfers heat to the nip, and to the backup member, through the thermal properties of the materials of the belt. The pressure comes from the physical properties of the members 60, 65 and their contact with one another. The heater 63 is formed from a substrate of ceramic or like material to which at least one resistive trace 66 is secured which generates heat when a current is passed through it. The controller C regulates the activity. One or more thermistors 69 are arranged to provide feedback to the controller regarding temperature.

The endless belt 62 is formed of multiple layers. It includes an innermost layer 71 formed of a flexible polyimide fused with conductive additives. It defines a highly thermally conductive (HTC) core and provides support for a middle layer 73 and outermost layer 75. The middle layer 73 includes mostly rubber, for insulation, while the outermost layer 75 is polytetrafluoroethylene, e.g. Teflon, having high strength, durability and flexibility. The polyimide ranges about 45-55 microns in thickness, while the rubber is 275 microns thick+/−50 microns and the Teflon is 12 microns thick+/−3 microns. The belt is circular, when not pressed against the backup member, thus distorting its shape, and has an inner diameter of about 25 mm. A belt of this type allows fusing at relatively low fusing temperatures which leads to low energy consumption, less media curl, longer life, and reduced fuser warm up time for the fuser assembly at start up.

The backup member 65, on the other hand, is any of a variety, but a traditional micro-balloon (porous foam) of about 30 mm works satisfactorily. The backup member 65 connects to a motor 77 via an integral shaft 79 and the motor turns the shaft to rotate the backup member. Rotation of the backup member, in turn, causes rotation of the endless belt 62 (as indicated by the direction arrows) to convey media through the fusing nip in the process direction. The controller C governs the speed of rotation in a feedback relationship with the motor. Alternatively, the motor rotates the heated member, which causes rotation of the backup member. Alternatively still, the fuser assembly utilizes an endless belt of layer(s) different than those noted or a heated member architecture based not on a belt, but a hot roll or other design.

To maintain acceptable fusing grade of the toner on the media and avoid hot/cold offset of the first sheet of media of the imaging operation, the controller executes a variety of actions. First, the controller operates the motor 77 to rotate the backup member for as long as possible at a speed lower than the process speed needed for an imaging operation. In this way, the materials of the heated and backup members do not overheat the fusing nip before fusing a first sheet of media. (The controller later increases the speed of the motor to the process speed in time for a leading edge (L.E. FIG. 1) of the media to reach the fusing nip so that the speed of the media and the nip rotation are matched.) Second, it causes the heater 63 to heat the heated member 60 to a temperature, warm up temperature, lower than the fusing temperature before paper reaches the fuser nip N. Upon the first sheet of media of the imaging operation arriving at the fusing nip N, it heats the heated member 60 to the second temperature, fusing temperature. In this way, the relatively high initial temperature of the fusing nip at the leading edge of the first sheet compensates for the expected drop in temperature that occurs during rotation of the backup member to advance the media through the nip. In some instances, the fusing nip drops in temperature as much as 60° C. over three revolutions of the backup member during fusing the first sheet (or 15-20° C. per revolution of the backup member when advancing the media from its leading edge to trailing edge). Thereafter, the controller resets the fusing temperature of the heater 63 based on current backup member temperature for second or subsequent sheets of media of the imaging operation, which could be higher or lower.

If the fuser assembly can fuse toner to media at both a fast process speed and a slow process speed for two modes of imaging operations, whereupon a request to commence a faster of the two modes of imaging operations, the motor 77 is operated first at the slower of the two process speeds to keep cool the fusing nip. Thus, if imaging operations can occur at both 40 pages per minute (ppm) and 25 ppm, the operation of the motor 77 is first rotated at the slower process speed of 25 ppm during the time before arrival of the first sheet of media. Thereafter, the speed of the motor is increased to 40 ppm to match together the speed of the media to the fusing nip. The time it takes to increase operation of the motor speed from the slower to the faster process speed has been found to be on the order of about 0.5 seconds. Alternatively, the controller operates the motor 77 at any speed lesser than the process speed of the imaging operation to keep cool the heated and backup members before the arrival of the first sheet of media. Still other designs contemplate operating the motor at the slower speed as a fractional multiple of the process speed of the imaging operation, such as ½ speed of the process speed.

Concurrent with motor operation, the controller also coordinates together activities of the fuser assembly to meet various specifications of a given imaging operation. Among others, the controller coordinates the time it takes to first print the media (time-to-first-print, TTFP) along with the time it takes to warmup to a proper fusing temperature a relative cold fusing nip. The latter, however, changes based upon a current temperature of the fusing nip. The colder the nip, the more aggressive the controller must activate the heater 63 to heat the heated member 60 to be ready to meet the TTFP. Conversely, the warmer the nip, the less aggressive the controller must heat the heater 63. To obtain the current temperature, the controller receives a signal from the thermistor 69 that measures a current temperature of the backup member 65. Correlated to that, and accessible to the controller as stored in memory, are temperature values of the heater 63. As seen in graph 81, the temperature values are listed for the heater 63 as based on the current temperature of the backup member 65. They both are also stored in memory per a type of the media, e.g., 24# paper, and the process speed of the imaging operation, e.g., 40 ppm. (Types of media are well known and include parameters, such as plain paper, bond paper, glossy paper, velum paper, film, or the like.) The graph of temperature values also includes the temperature of the heater 63 to warm it up before arrival of a first sheet of media at the fusing nip, curve 91, and the steady state fusing temperature of the heater 63 during ongoing imaging of second or subsequent sheets of media to fuser toner, curve 93.

As an example of operation, if a backup member 65 has a current temperature of 30° C., the controller operates the heater 63 at 210° C. to warm up the fusing nip before arrival of the media, as indicated at point 83 on curve 91. To actually reach the fusing temperature of the imaging operation, however, the controller activates the heater 63 to operate at 219° C., as indicated at point 85 on curve 93. In contrast, if the current temperature of the backup member 65 is much hotter than 30° C. at 114° C., for example, the controller operates the heater 63 at 185° C. to warm up the fusing nip, as indicated at point 87 on curve 91, and at 196° C. to reach the fusing temperature, as indicated at point 89 on curve 93. As the temperature values for the graph 81 are empirically derived by the inventors through extensive testing, other values are possible, especially as a function of the material set of the heated and backup members of the fusing nip and the design parameter TTFP. It should be also noted that that the difference between the warmup temperature, curve 91, and the steady state fusing temperature, curve 93, exists in a range of about 10-20° C.

Figure 3:
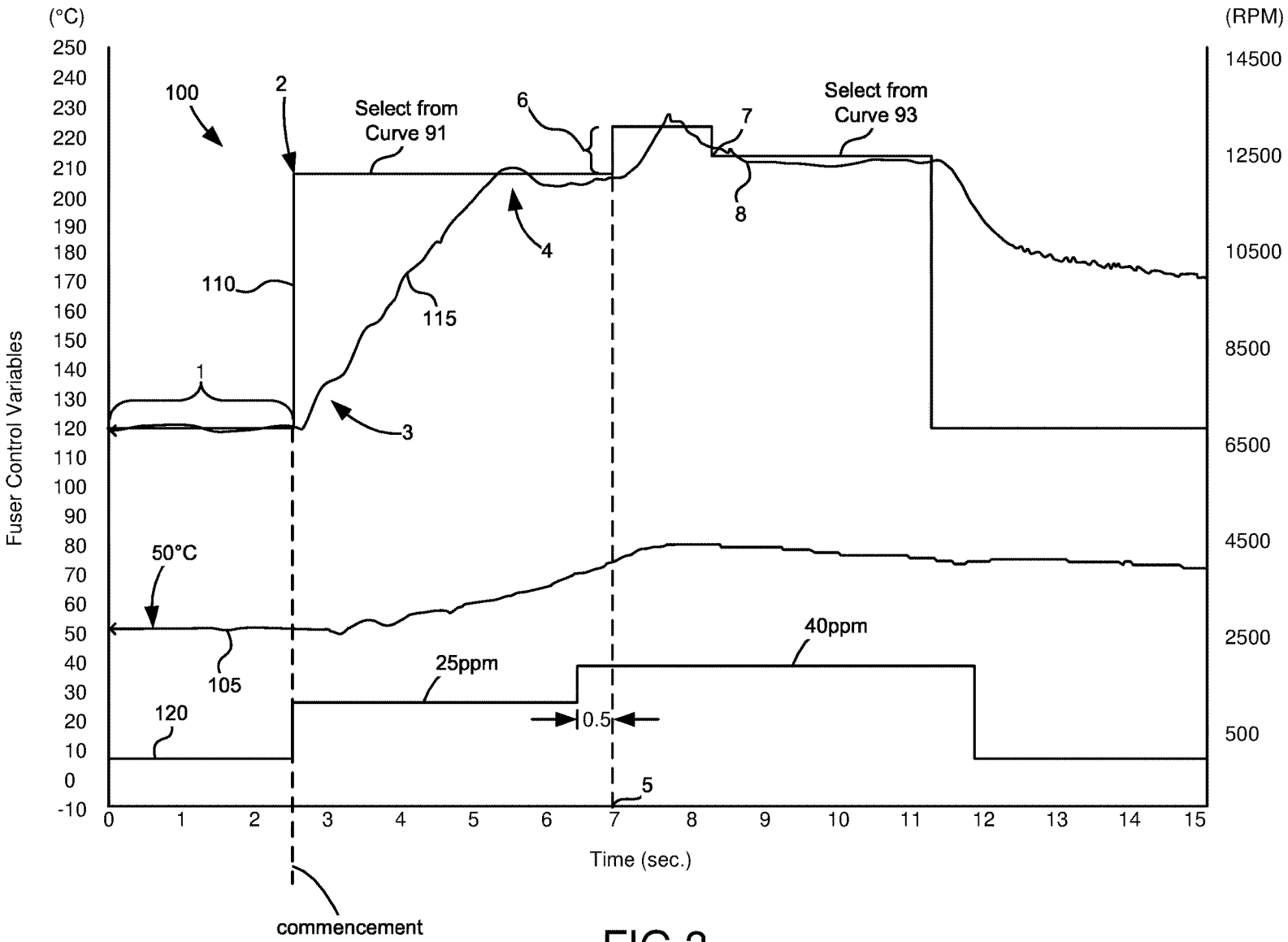
FIG. 3 is a graph showing representative correlation of control variables for the fuser assembly, including temperature and motor speed and operation therefor.

With reference to FIG. 3, a more detailed graph 100 notes the variables executed by the controller and its effect on various components. The graph superimposes many curves. As seen, the temperature of the backup member is given as curve 105. It is inferred from the temperature of the thermistor provided to the controller. The temperature of the heater as caused to operate by the controller is given as curve 110. The curve of the heated member in response to the operation of the heater is noted as curve 115. The curve of the operation of the motor is given as curve 120. Also, the temperature curves 105, 110, and 115 correspond to the left-hand axis given in ° C., whereas the curve of the motor corresponds to the right-hand axis given in motor RPM. All curves are noted with respect to time (seconds).

At curve section 1, of curve 110, the advance start temperature at which the heater is operated before commencement of imaging is chosen to be sufficiently low to provide for warming the heated member without overheating the fusing nip components (e.g., endless belt 62 and backup member 65). In this example, the value is given as 120° C. Thereafter, upon the actual commencement of the fuser assembly to fuse media in an imaging operation, the controller causes heating of the heater, at point 2, to correspond to the warmup temperature as selected from curve 91 (FIG. 2). In turn, the heater temperature corresponds to the temperature of the backup member as measured by the thermistor, or 50° C. As the heated member takes time to respond to the temperature change of the heater, the curve of the heated member 115 lags curve 110, but starts to rise around point 3 and continues getting warmer until it reaches the temperature of the heater, such as near point 4.

At this time, the controller also operates the motor to rotate at a first speed slower than the full processing speed of the imaging operation. That is, the motor (curve 120) operates at 25 ppm (around 1000 RPM) for as long as possible until it becomes critical to increase the motor speed to 40 ppm (around 2000 RPM) to match the speed of the fusing nip to the processing speed of the imaging operation. In this instance, the motor operates at 25 ppm beginning at around 2.5 seconds until about 0.5 seconds before the first sheet of media reaches the fusing nip wherein the motor begins operating at 40 ppm (e.g., the processing speed of the imaging operation). In this way, the fusing nip is kept relatively cool when no media is present and hot offset is avoided when imaging the first sheet of media. Then, as the leading edge of the first sheet of media reaches the fusing nip, given at dashed line 5 (at time 7 seconds), the controller increases the temperature of the heater (point 6) to warm the heated member at a fusing temperature as found from curve 93, FIG. 2. The bump in temperature above the warmup temperature is empirically derived, but it approximates 10° C. above the warmup temperature, as based on the material sets of the endless belt and backup member. In any amount, the bump makes for a relatively high initial temperature of the fusing nip as the leading edge of the first sheet arrives at the nip and compensates for the expected drop in temperature that occurs during rotation of the backup member to advance the remainder of the media through the nip. For second or subsequent sheets of media of the imaging operation, the controller resets fusing temperature based on current backup member temperature (point 7) as noted in curve 115 around point 8, which could be higher or lower than the steady state fusing temperature storing in controller memory. Of course, the values of graph 100 change per a different initial temperature of the backup member and the available speeds of operating the motor. The relative shapes of the curves 105, 110, 115 and 120, however, remain generally the same.

With reference back to FIG. 1, an inter-page gap (IPG) between adjacent sheets of media 12, 12' of the imaging operation can be also measured. If such a gap is excessively large, another full or partial execution of the operation of the motor curve 120 and/or implementation of some or all of the operation of curve 110 as a function of the backup member curve 105 can be implemented. The IPG can be measured in time, distance or both between the trailing edge (T.E.) of a leading sheet of media and the leading edge (L.E.) of the next sheet of media, for example. Various sensors in the media path can be placed to effectuate this, as is known in the art. A typical time between adjacent sheets, however, falls in the range of about 1-3 seconds at a process speed of 40 ppm.

The relative advantages of the various embodiments should be now apparent to those skilled in the art. Some express advantages include but are not limited to: reduced fuser nip revolutions, thereby extending the useable life of the fuser assembly; reduced torque, which reduces wear on components; and reduced acoustical emissions (noise typically increases with both torque and motor velocity).

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. A method of controlling a fuser assembly in an imaging device having at least two process speeds for imaging media, the fuser assembly having a heated member warmed by a heater and a corresponding backup member defining a fusing nip at which toner becomes fused to the media at a fusing temperature and a process speed of the two process speeds during an imaging operation, wherein a motor causes rotation of either or both the heated and backup members, comprising:

upon request to commence the imaging operation at a first of the two process speeds, measuring a current temperature of the backup member;

providing the current temperature to a controller of the imaging device;

obtaining by the controller from memory a correlation of the current temperature of the backup member to plural temperature values for operating the heater by providing a signal from the controller to heat the heater, thereby heating the heated member to a warm up temperature or a steady state fusing temperature;

signaling to the heater from the controller a first of the plural temperature values to warm up the heated member and signaling to the motor from the controller to operate the motor at a second speed slower than the first of the two process speeds;

at a time about 0.5 seconds before a first media arrives at the fusing nip, increasing the speed of the motor from the second speed to the first of the two processing speeds;

upon the arrival of the first media at the fusing nip, signaling to the heater from the controller a second of the plural temperature values to heat the heated member to the steady state fusing temperature; and for second or subsequent sheets of media of the imaging operation arriving at the fusing nip, reducing the temperature of the fusing nip by signaling from the controller to the heater another temperature value of the plural temperature values, the another temperature value being lower than the second of the plural temperature values.

2. The method of claim 1, further including providing again the current temperature to a controller of the imaging device after the first media passes the fusing nip.

3. The method of claim 2, further including obtaining again by the controller from the memory the correlation of the current temperature provided again of the backup member to the plural temperature values for operating the heater.

4. The method of claim 1, further including storing in the memory the correlation between a range of temperature values of the backup member to the plural temperature values for operating the heater.

5. The method of claim 1, wherein a difference between the warm up temperature and the steady state fusing temperature for the current temperature of the backup member is about 10° C.

6. The method of claim 1, further including providing the heated member as an endless belt formed of multiple layers, including an innermost layer formed of a flexible polyimide fused with conductive additives.

7. The method of claim 1, further including providing the heater as a ceramic substrate to which at least one resistive trace is secured which generates heat when a current is passed through resistive trace.

8. The method of claim 1, storing in the memory the plural temperature values as a function of a type of the first media.

9. The method of claim 1, further including operating the motor at the first of the two process speeds at 40 pages per minute.

10. The method of claim 1, further including operating the motor at the second speed at 25 pages per minute.

11. The method of claim 1, further including operating the motor at the first of the two process speeds at 2000 revolutions per minute.

12. The method of claim 1, further including operating the motor at the second speed at 1000 revolutions per minute.

13. The method of claim 1, further including measuring an inter-page gap between adjacent sheets of media of the imaging operation.

14. The method of claim 13, wherein the measuring further includes measuring a distance, time or both between the adjacent sheets of media.

15. The method of claim 1, further including determining a type of the first media before the signaling to the heater from the controller the first of the plural temperatures.

* * * * *